US005674434A

United States Patent [19]

Baptista et al.

[11] Patent Number: 5,674,434

[45] Date of Patent: Oct. 7, 1997

[54] DEVICE FOR THE CONTROL OF THE VACUUM

[76] Inventors: Fernando A. Baptista, Rua Padua Correia, 30, P-4400, Vila Nova de Gaia; Joao M. Pereira-Dias Baptista, Avenda Padre Sa Pereira, P-4740 Esposende, both of Portugal

[21] Appl. No.: 669,305

[22] PCT Filed: Jan. 11, 1995

[86] PCT No.: PCT/PT95/00002

§ 371 Date: Jul. 2, 1996

§ 102(e) Date: Jul. 2, 1996

[87] PCT Pub. No.: WO95/19496

PCT Pub. Date: Jul. 20, 1995

[51] Int. Cl.[6] ..... F02M 9/10

[52] U.S. Cl. ..... 261/64.4; 261/DIG. 59

[58] Field of Search ..... 261/DIG. 59, 64.3, 261/64.4

[56] References Cited

U.S. PATENT DOCUMENTS

| | | | |
|---|---|---|---|
| 1,413,371 | 4/1922 | Adler et al. | 261/64.4 |
| 1,433,545 | 10/1922 | Gilles | 261/DIG. 59 |
| 1,620,746 | 3/1927 | Weaver | 261/DIG. 59 |
| 4,123,233 | 10/1978 | Mannino | 261/64.4 |

FOREIGN PATENT DOCUMENTS

| | | |
|---|---|---|
| 947703 | 7/1949 | France . |
| 2492463 | 4/1982 | France . |
| 57-140520 | 8/1982 | Japan . |
| 58-106159 | 6/1983 | Japan . |

*Primary Examiner*—Tim R. Miles

*Attorney, Agent, or Firm*—Hoffman, Wasson & Gitler, P.C.

[57] ABSTRACT

The invention refers to a device to regulate the dosage of fuel, to be used in engine feeding systems by suction of the fuel. The device is to be set in the main conduit of air, overlays the diffuser (7) and involves a set of laminar elements (1) displayed in a radial way according to a common plan, being the fastening of its peripheral extremities achieved by means of its insertion in a double ring (2) which bears a central shutter through narrow radial extensions (6). The ring is fixed to a supporting base with saliences (4) to overcome the spaces between the laminar elements and reenterings (5) to allow its flexure. The flexure of the laminar elements is performed through a calculated progression according to a proper gradient resulting into the formation of in-between spaces (3). Countering the increase of the speed of the current of air, a calculated increase in the area of the sections of the in-between spaces, allow to obtain the regulation of a value of vacuum in the area surrounding the diffuser, vacuum which, in its turn, will determine a debt of fuel proportional to the volume of the current of air in such a way that a correct dosage of the mixture air/fuel in the whole range of rotation of the engine is achieved.

7 Claims, 1 Drawing Sheet

DEVICE FOR THE CONTROL OF THE VACUUM

This application is a 371 of PCT/PT95/00002.

TECHNICAL DOMAIN

This invention concerns complementary arrangements to regulate the dosage of fuel, applied to engine feeding systems by suction of the fuel, in order to obtain a air/fuel ratio of the mixture which will fulfill the conditions for a correct performance of the engines in the whole range of regimes of rotation.

If we regulate a carburettor of a simple construction to the correct relation of mixture for a maximum number of rotations, this mixture will be too poor in what the low regimes are concerned. On the contrary, if we choose a relation of mixture suitable for low regimes, this mixture will be too rich for the maximum number of rotations.

PREVIOUS TECHNIQUE

To minimize these inconvenients, arrangements of complementary regulation included in the carburettors have been idealized and these could shortly and in a generic way be specified in the following types according to the description of Dante Giacosa in his book "Endothermic Engines", Ed. Omega, Barcelona, 14th edition, pages 370/3:

- Compensating gauge carburettors (Zenith) where the action of the main gauge, regulated to the suitable dosage in a maximum of rotations, is corrected through a secondary or compensator gauge which enriches the mixture in low regimes.
- Carburettors of suplementary air (Krebs-Pallas) where the mixture dosed to low regimes is impoverished to the high regimes through the aspiration of suplementary air, by means of conduits placed under the diffuser.
- Carburettors of antagonistic air (Solex-Weber) where the mixture, also regulated to low regimes is impoverished in the high regimes by means of air that, required by the same depression, acts antagonistically to the fuel.
- Carburettors of double conduits of air where the main flow of air is subdivided by two conduits of aspiration, acting, one of them, to the low regimes of rotation and the two of them together to the high regimes.

However the referred arrangements of complementary regulation depend on the actions of movement which use routes of fuel and air in suplementary conduits—mechanical elements, as springs and small levers. These actions involve an appreciable inertia which prevents or delays the timely and strict adjustment in order to obtain a well balanced dosage in all the extent of rotation regimes.

Adding to these difficulties, such complementary arrangements are performed integrating them in the carburettors which increases the complexity of its construction.

EXPLANATION OF THE INVENTION

The aim of the invention is to solve these problems by means of a device which regulates the vacuum and which acts directly and immediately in the main current of air. The active laminar elements which constitute the essential point of the device have a very weak inertia and this characteristic allows them to react in an almost instantaneous way to the changes of the regime of rotation by flexing variably according to the changes of speed in the main current of air.

From the variation of the amplitude of the bending of the laminar elements results the formation between them of an in-between space aimed at the passage of the current of air, whose area is of variable size according to the variation of speed of the current of air and according to the resistence to the flexure selected for the laminar elements.

An important advantage of the invention stays in the possibility of mutual adjustment of the mentioned variables in such a way that, from it, it results, in the space of the conduit that surrounds the diffuser of fuel, the regulation of a certain value of vacuum which, in association with a proper value of the gauge which gives fuel to the diffuser allows to obtain a correct dosage in the whole range of rotation with special incidence to the high regimes.

Another important advantage is the fact that each device and each carburettor constitute independent units simplifying its modulation and allowing a functional construction of accurate exactitude.

One of the ways by which the invention can be build up is found next, in detail, with a reference to the drawings which only represent one way of making it.

Figure 1:
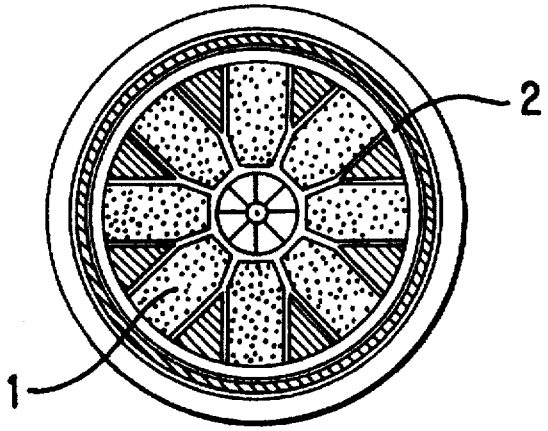
FIG. 1 displays a view of the device whose laminar elements (1) are keeping a flat form because they have not been pushed yet by the current of air to some angle of flexure.

As one can notice from the drawings, an example of the device according to the present invention is constituted by a set of laminar elements (1) displayed in a radial form following one only plan, being the fastening of its peripheral extremities done by means of its insertion in a double ring (2) which also bears a shutter in central position (6) through narrow radial extensions.

Each laminar element is constituted by a small rectangle of steel blade with a thickness and corresponding resistance to the flexure calculated in such a way that it can be flected in its maximum curvature when pressed by the current of air at its maximum speed.

The set of the laminar elements is fixed to a bearing base, having, this one, saliences (4) and recesses (5) the saliences being for the purpose of closing the radial spaces which were left free between the laminar elements and the recesses having a depth surface profiled with a modelled curvature which allows the progressive settling of the elements according to a gradient of flexure calculated for a range of rotations.

The central shutter (6) is an element with a static position whose profile is modelled in order to contribute, together with the gradient of the flexure of the laminar elements to the formation of the in-between spaces of progressive area.

Figure 3:
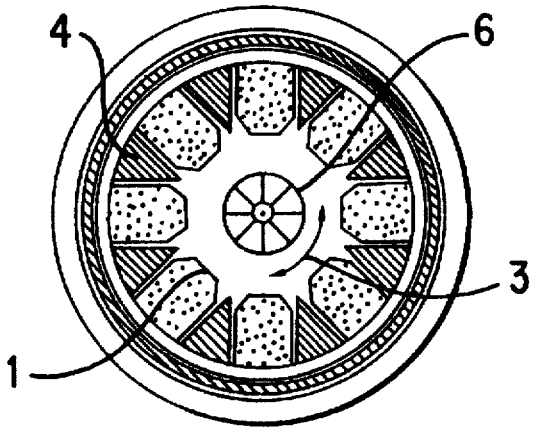
FIG. 3 displays a view of the device where the laminar elements are totally flected allowing the formation of an in-between space with its maximum value of the area (3).
Figure 2:
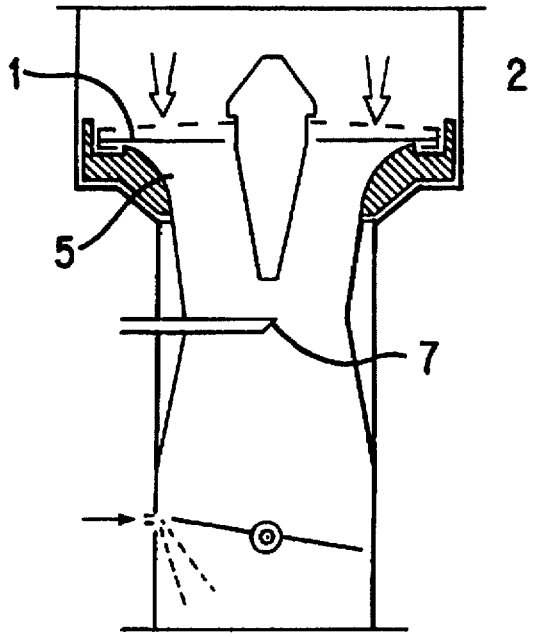
FIG. 2 displays a cross-section of the device inserted in the entrance of the main current of air, overlaying the diffuser, and also shows the curvilinear shape of each support (5) which shapes the flexure of each laminar element.
Figure 4:
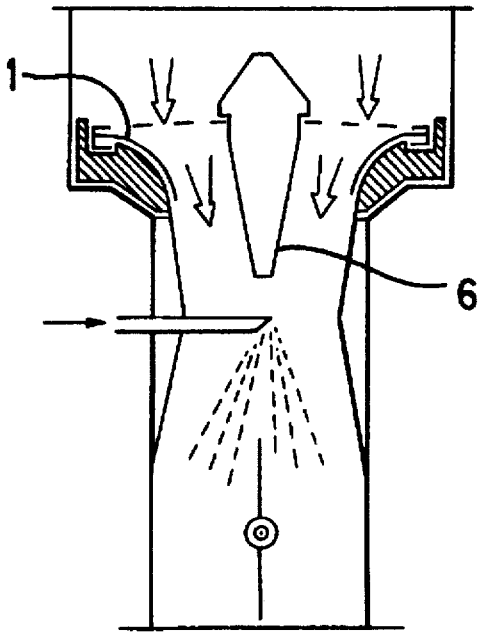
FIG. 4 displays a cross-section of the profile of the central shutter (6), the complete bend of the laminar elements together with the profile of the respective supports and shows the in-between space for the passage of the current of air corresponding to the maximum rotation.

When the rotation is minimum, the strength of the current of air does not allow enough pressure to flect the laminar elements (FIGS. 1 and 2). As the engine rotation increases, also increases the strength of the current of air and consequently increases the flexure of the laminar elements resulting from this an increase of the in-between area too (FIGS. 3 and 4).

This increase of the in-between area following a calculated progression according to an adequate gradient, countering to the increase of the speed of the air, determines the regularization of a vacuum value in the area surrounding the diffuser, this value of vacuum, on its turn, determining a flow of fuel which is proportional to the volume of the current of the air and so equivalent to a correct dosage of the mixture air/fuel.

The use of this invention to engine feeding systems by suction of the fuel will prevent the excess of consumption mainly in the high regimes of rotation, preventing consequently major pollution of the environment.

We claim:

1. A device to regulate a vacuum applied in engine feeding systems, comprising a set of laminar elements placed in a main suction-air passage, said elements being bendable to change a passage opening area in accordance with variations in an air current, wherein said laminar elements (1) are distributed in a radial way in a common plan, with outer peripheral extremities fastened by insertion in a double ring (2), one having narrow radial extensions which bears a central shutter (6) and wherein said double ring is mounted in a bearing base which is modelled in such a way as to cooperate with said laminar elements in the guild up of a flexure gradient of said laminar elements.

2. A device to regulate said vacuum, according to claim 1, wherein said bearing base comprises saliences (4) and recesses (5), said saliences fills in radial spaces between said laminar elements and said recesses to cooperate in the build up of a calculated flexure gradient of said laminar elements.

3. A device to regulate said vacuum, according to claim 1, wherein said laminar elements comprise segments of a steel blade, said blade having a thickness and a corresponding resistance to a flexure calculated in such a way that, while bending, they follow a bottom surface of corresponding recesses of a bearing base, in accordance with changes in pressure of the air flow, caused by a change in angular velocity of an engine.

4. A device to regulate said vacuum, according to claim 3, wherein said recesses have a bottom surface with a curvilinear profile modeled in order to cooperate in the build up of a calculated flexure gradient of said corresponding laminar element while allowing its gradual settling, avoiding cumulative vibrations and extemporaneous rupture.

5. A device to regulate said vacuum, according to claim 4 wherein said flexure of the laminar elements is done according to a calculated progression resulting from this gradual flexure, the formation of in-between spaces (3) where an area of respective sections varies according to a certain gradient, proportional to a volume of a current of air.

6. A device to regulate said vacuum, according to claim 5, further comprising a central shutter with a profile in accordance with a gradient calculated for a variation of formation of in-between spaces.

7. A device to regulate said vacuum, according to claim 6, wherein countering to each increase of speed of said current of air, a calculated increase of said area of said sections of said in-between spaces allow a regularization of a value of vacuum in an area that surrounds a diffuser (7), said vacuum determines a debt of fuel proportional to said volume of the current of air in such a way that a correct dosage of a mixture air/fuel, in a whole range of rotation of said engine, is achieved.

* * * * *